United States Patent [19]

Hartness et al.

[11] Patent Number: 4,587,792

[45] Date of Patent: May 13, 1986

[54] APPARATUS FOR OPENING BOX FLAPS ON AN ARTICLE LOADING MACHINE

[75] Inventors: Thomas S. Hartness; E. Leon Hopkins, both of Greenville, S.C.

[73] Assignee: Hartness International, Inc., Greenville, S.C.

[21] Appl. No.: 638,256

[22] Filed: Aug. 6, 1984

[51] Int. Cl.[4] ..... B65B 43/39

[52] U.S. Cl. ..... 53/382; 53/387; 493/183

[58] Field of Search ..... 53/382, 381 R, 497, 53/248, 492, 374, 387; 493/183, 453

[56] References Cited

U.S. PATENT DOCUMENTS

| | | | |
|---|---|---|---|
| 3,376,692 | 4/1968 | Berney | 53/382 |
| 3,694,993 | 10/1972 | East | 53/497 X |
| 3,852,942 | 12/1974 | Johnson et al. | 53/382 |
| 4,191,005 | 3/1980 | Vinoskey | 53/382 |

*Primary Examiner*—James F. Coan

*Attorney, Agent, or Firm*—Dority & Manning

[57] ABSTRACT

Apparatus is disclosed for opening the major and minor flaps of a box container being conveyed on an article loading machine designated generally as (A). The apparatus includes a flap opening foot (*54*) carried on the end of a rocker shaft (46) which is, in turn, carried on a carriage (48). The end of the rocker shaft is attached to a bell-crank lever having an arm (80) and a pin (82) which travels in a cam slot (52) formed in an elongated guide plate (50). The guide plate (50) is clamped onto the edge of a side flap engaging plate (68). The slot (52) is contoured to impart a rocking motion to the foot (54) through the bell-crank linkage so that the foot dips under a closed flap (16*a*) of the box and lifts it toward an open position. An elastic cord (110) engages the flap and retains it in the open position. A rear minor flap opening device is illustrated at (102) which includes a claw (104). The arm (102) is pivotable and as the box (16) is conveyed therebeneath, the claw (104) catches a closed end flap (16*d*). The forward conveyance of box (16) causes the flap to unfold toward its open position and when engaged by the elastic cord (110) the flap is pushed fully open and held therein. The side flaps (16*d*) and (16*c*) remain held by flap engaging pairs of plates (68) and (69).

26 Claims, 13 Drawing Figures

Fig. 9.
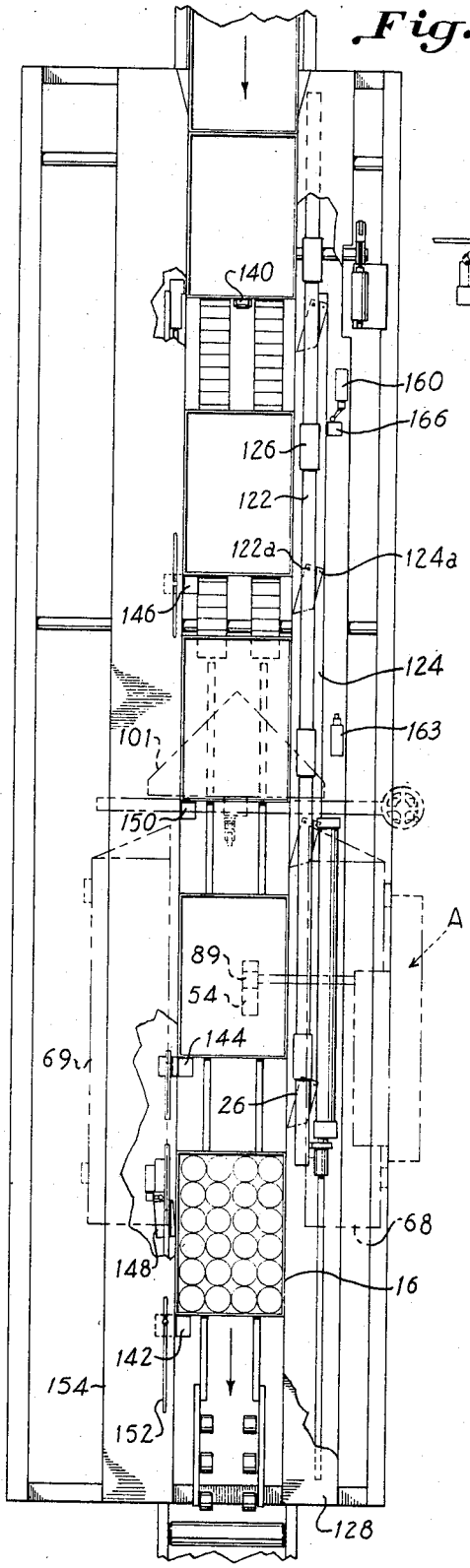
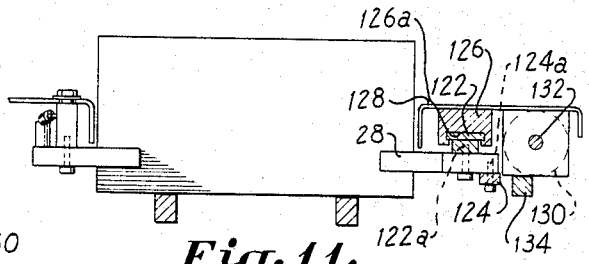
Fig. 11.
Fig. 10.
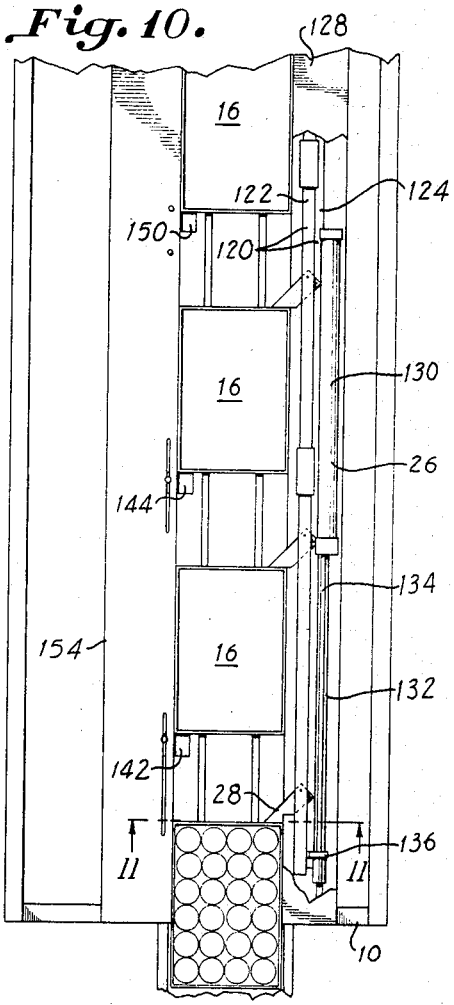

APPARATUS FOR OPENING BOX FLAPS ON AN ARTICLE LOADING MACHINE

BACKGROUND OF THE INVENTION

The invention relates to an article packing machine and more particularly to the box flaps on such a machine so that the top of the box is open for the loading and packing of articles in the box.

In the packing of bottles and other containers into boxes, the cardboard boxes are typically conveyed to an article loading station beneath a grid set. Articles are conveyed on an upper conveyor to the grid set which arranges the articles for loading and packing into the box.

The problem occurs in the loading of articles into cardboard boxes having closure flaps of insuring that the closure flaps are open so the top of the box is open for loading of articles. Heretofore, a plow-shaped device has been utilized to spread open the major side flaps of a cardboard box and the minor rear end flap is also sometimes engaged and opened by the plow-shaped device. Once opened, the side flaps are fed between two vertically spaced rods on each side of the box. The rods hold the flaps open as the box is conveyed. The arrangement is not suitable to accommodate a variety of different size flaps since short flaps will easily slip between the rods.

The problem of opening the minor end flaps is a problem which has not been satisfactorily met. In particular, ineffective devices have been proposed for opening the rear minor flap such as a loose chain hung above the box which falls into the box and drags a closed flap open as the chain is dragged across the flap.

In furtherance of the present invention there has been disclosed flap opening apparatus for use with a reciprocating rake conveyor which advances containers incrementally for processing along a conveyor line leading to an article loading station. This conveyor lends itself readily to the location of a flap opening station at one of the advancement positions where the box is stopped reliably. At a flap opening station the apparatus of the present invention is advantageously employed to open the end and side closure flaps of the cardboard box prior to being advanced to the article loading station.

Accordingly, an important object of the present invention is to provide apparatus for effectively opening the closure flaps of a cardboard box being conveyed on an article loading machine prior to being filled with articles.

Still another important object of the present invention is to provide a simplified flap opening mechanism for use on an article loading machine which is both reliable and inexpensive to manufacture and use.

Still another important object of the present invention is to provide apparatus for opening the end and side closure flaps of a cardboard box being conveyed on an article loading machine prior to being filled with articles which may be used with a reciprocating rake conveyor which advances the boxes incrementally along a conveyor path and stops the containers precisely at a fixed location for carrying out the flap opening process.

Still another important object of the present invention is to provide apparatus for opening closure flaps of a box being conveyed on an article loading machine which retains the flaps in an open position while being conveyed.

Still another important object of the present invention is to provide apparatus for opening the closure flaps of a box being conveyed on an article loading machine which includes a rocker foot which dips underneath the closed flap and lifts it toward an open position reliably in a prescribed manner while the box is stopped at a flap opening position.

Still another important object of the present invention is to provide a flap opening foot which moves both in a rotational and translational movement to engage underneath the closed flap and raise it to an open position in which a unique cam slot and bell-crank follower are utilized to move the flap opening foot in a prescribed motion.

Still a further important object of the present invention is to provide a flap opening foot which may be adjusted in its rocking stroke to lift a closed flap of a cardboard box on an article conveying machine in which the flap engaging foot may be adjusted in its position to dip in and out of a partitioned socket in the cardboard box while engaging the flap.

SUMMARY OF THE INVENTION

The above objectives are accomplished according to the present invention by providing a flap opening mechanism which may be carried on the conveyor frame of the conveyor of an article packing machine which opens the closed flaps of a cardboard box on the conveyor. The mechanism includes a stationary guide plate carried by the conveyor frame which has a cam slot formed in the plate. A carriage which slides on the guide plate carries a rotatable rocker shaft having a flap engaging foot carried on the end of the shaft. There is a cam follower affixed to the end of the rocker shaft which travels in the cam slot. The cam slot imparts a prescribed flap opening motion to the rocker foot. In the prescribed motion, the rocker foot dips beneath a closed end flap of a cardboard stopped at the flap opening station to lift the flap toward an open position. An elastic cord engages the flap and holds it open. A pivotable arm is carried above the conveyor platform on which the boxes are conveyed and catches the edge of a closed rear flap of the cardboard box being conveyed past a claw of the arm. As the box is conveyed past the claw, the rear flap is pulled rearwardly to move it from a closed toward an open position where it is held by the cord. After the box is stopped, the front flap opening device is moved forward to move the rocker foot into engagement with the front flap to open it. While the flap opening operations are being carried out, the side flaps of the cardboard box are held and constrained by a pair of spaced side plates between which the flaps are sandwiched so as to hold the box against the flap opening forces. The elastic retaining cord extending along the length of the conveyor above the boxes retains the open rear and front flaps in their open position while being conveyed to the article loading station.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIGS. 9 and 10 are plan views of a conveyor which incorporates box flap opening apparatus according to the invention in the return and advance stroke positions thereof;

FIG. 11 is a section taken along 11—11 of FIG. 10; and

DESCRIPTION OF A PREFERRED EMBODIMENT

Figure 1:
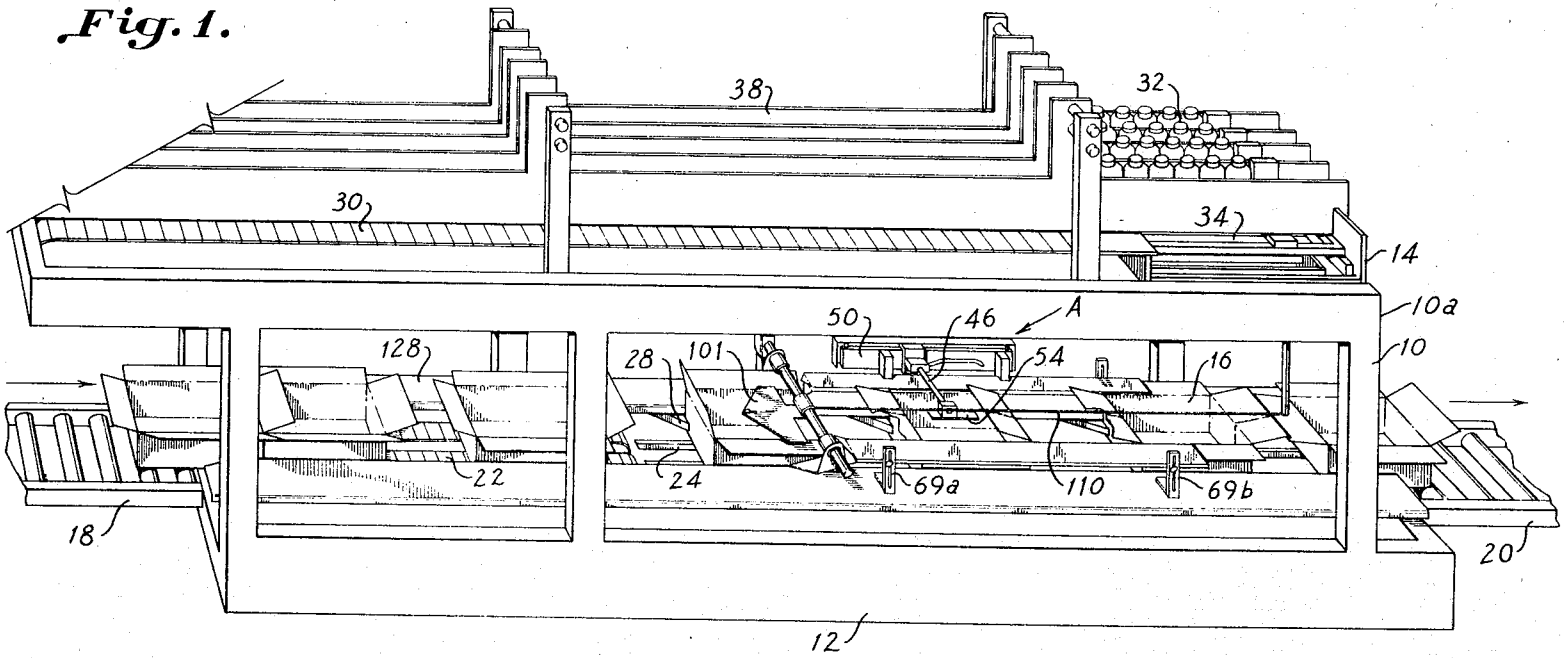
FIG. 1 is a perspective view illustrating an article packing machine incorporating apparatus for opening the flaps of a box conveyed on the machine.

Referring now in more detail to the drawings, an article loading machine is illustrated which includes a machine frame 10 which includes a lower conveyor frame 12 and upper conveyor frame 14. The lower conveyor frame 12 carries a conveyor for conveying boxes 16 which includes an infeed conveyor rack 18 and an outfeed conveyor rack 20. The conveyor further includes a pair of travelling belts 22 and a stationary conveyor platform 24 on which the boxes 16 are conveyed by means of a reciprocating rake conveyor 26 having a plurality of rake dogs 28 which engage the boxes 16 to advance them incrementally along the conveyor. The rake conveyor will be described more fully hereinafter.

An article conveyor 30 is carried on the upper frame 14 of the machine frame for conveying articles such as bottles 32 to a bottle loading station at which a grid set 34 loads them into the boxes. The grid set 34 may be any suitable elevator grid set such as that disclosed in U.S. Pat. No. 4,215,521. The articles are loaded into the grid set which arranges the bottles individually and the grid set is then lowered in proximity to the boxes 16 such that the bottles are deposited into the containers gently.

Article conveyor 30 further includes a series of lanes 38 which divide the bottles into rows prior to being fed into the grid set.

Carried on the conveyor frame 12 is a flap opening mechanism designated generally as A for opening the flaps of the boxes on the conveyor 24. The flap opening mechanism is attached to the conveyor frame 12 by means of a pair of spaced adjustable standards 40 and 42 as will be described more fully hereinafter.

There is a rocker shaft means included in the flap opening assembly which includes a rocker shaft 46 which turns in rotational movement while being carried in translational movement by a carrier means in the form of a carriage 48. There is an elongated guide plate 50 which includes a cam slot 52. The carriage 48 slides over the guide plate 50.

Figure 5:
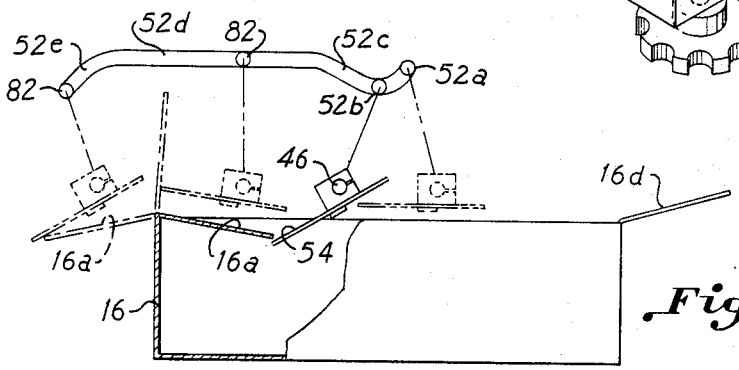
FIG. 5 is an elevation illustrating a flap engaging foot for opening end flaps of a box on an article packing machine constructed according to the present invention.
Figure 6:
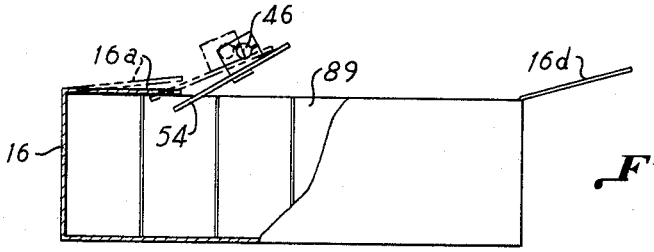
FIG. 6 illustrates a flap opening foot of apparatus for opening the flaps of a box on an article packing machine wherein the boxes include partitioned sockets.
Figure 7:
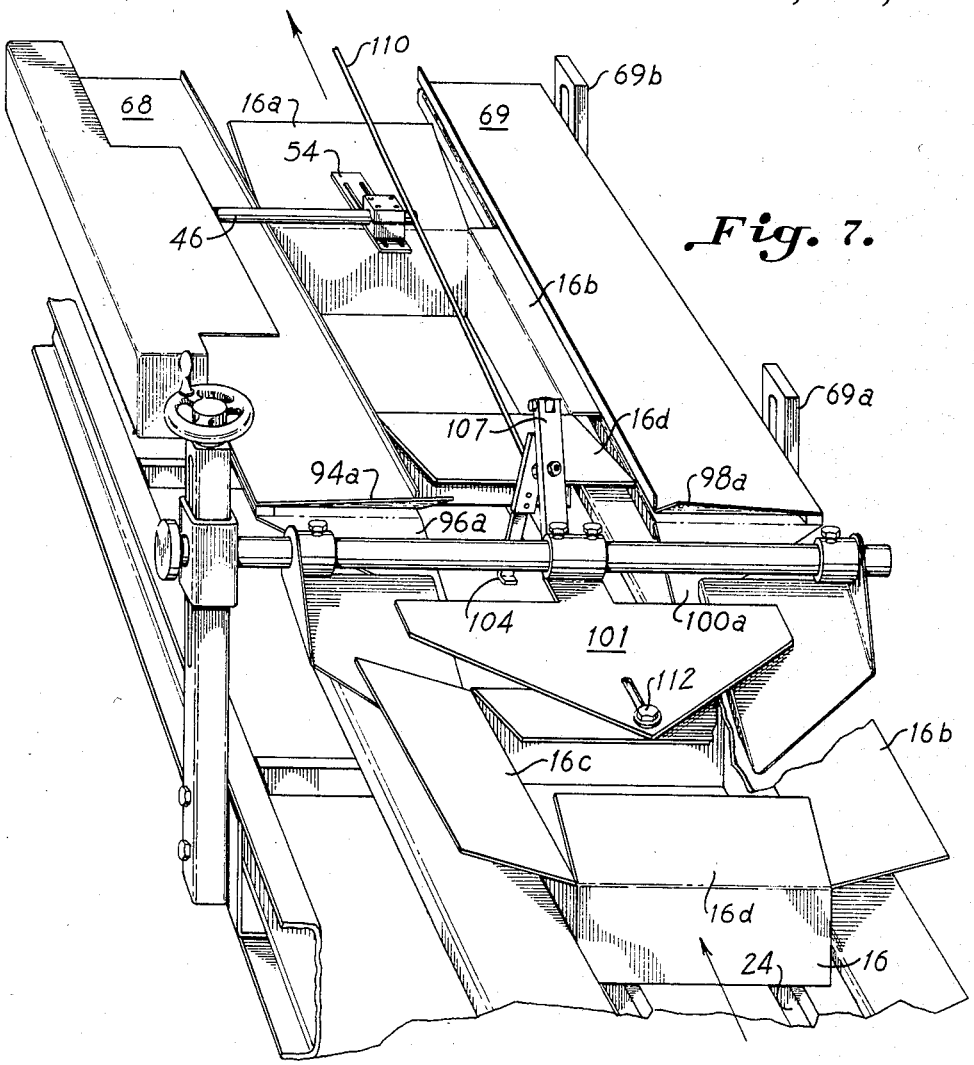
FIG. 7 is a perspective view of the entrance end of apparatus for opening the flaps of a box container constructed according to the present invention.
Figure 8:
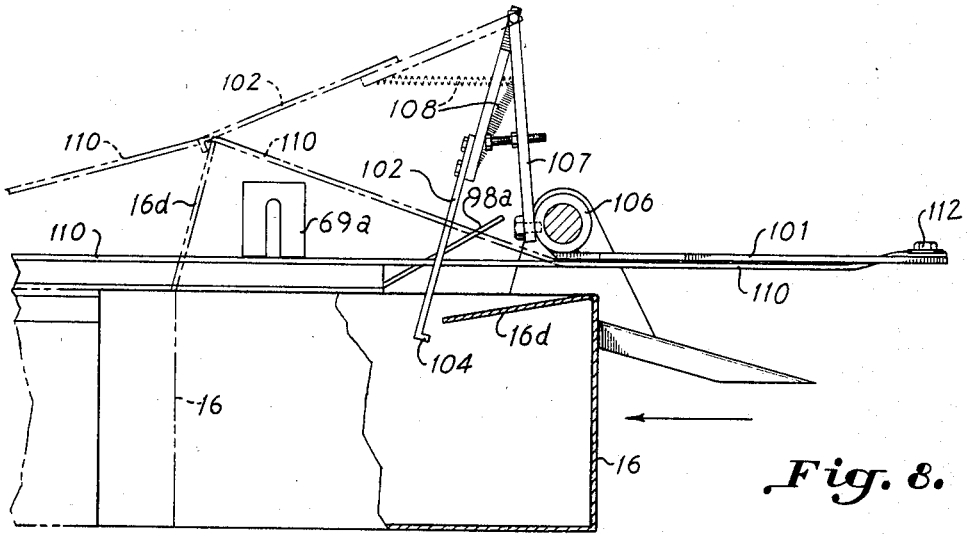
FIG. 8 is an elevation illustrating apparatus for opening a rear minor flap of a box container according to the invention.

There is a flap opening means carried on the end of rocker shaft 46 in the form of a flap engaging foot means 54 fixed to the end of the shaft 46. The flap engaging foot means 54 engages a front minor or end flap of the box 16 to move a closed flap toward an open position as can best be seen in FIGS. 5 and 6.

Figure 3:
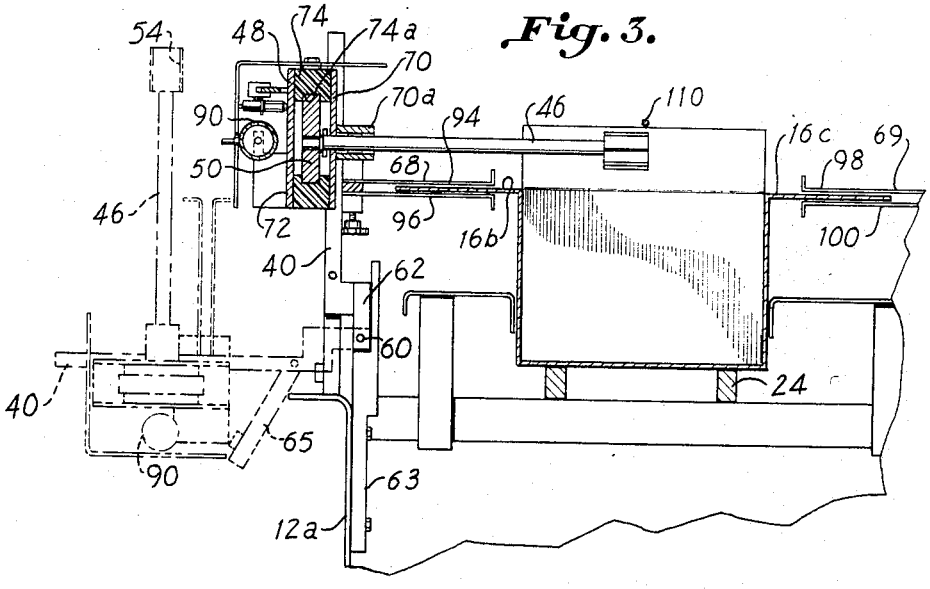
FIG. 3 is a sectional view taken along line 3—3 of FIG. 2.
Figure 4:
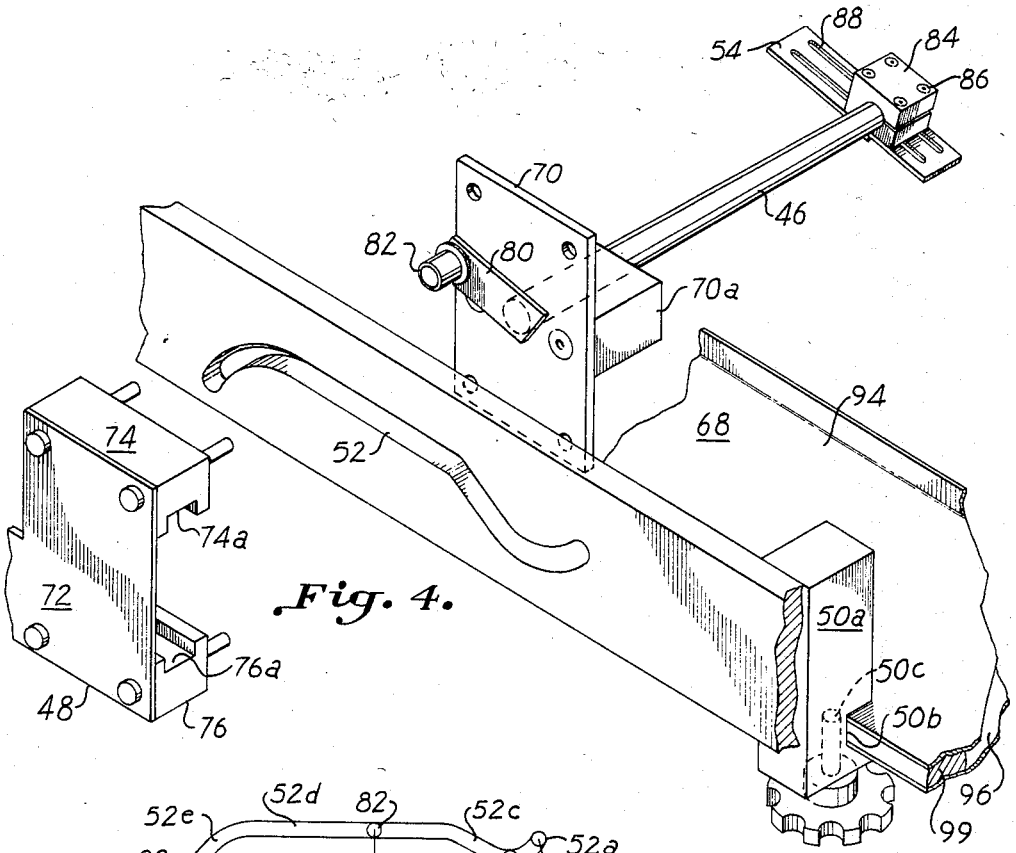
FIG. 4 is a perspective view with parts separated illustrating apparatus for opening minor end flaps of a box conveyed on an article loading machine according to the present invention which more particularly illustrates the elements for moving the flap opening engagement foot in a prescribed flap opening motion.

Referring to the standards 40 and 42 which mount the flap opening mechanism to the machine frame, it will be noted that these standards are pivotable to a dotted line position shown in FIG. 3 so that the entire flap opening mechanism may be pivoted out of operation from the conveyor. For this purpose, the standards 40 and 42 are connected to the frame by means of a pivot 60 via a bracket 62 which is pivotably attached at 60 to a leg 63 integrally attached to side frame **12*a* by any suitable means such as by bolting. A cross-brace 64 is attached to legs 65 which are pivotably attached to 40 and 42. The legs 65 rest atop frame 12*a* in an upright position and fold outwardly when mechanism A is pivoted to the dotted line position as can best be seen in FIG. 3**.

Attached by bolts 67 to the tops of legs 40 and 42 is side flap opening means 68. Side flap opening means 69 is carried on the opposing side of the conveyor by legs **69*a* and 69*b*. Guide plate 50 is carried on the edge of side flap opening means 68 by spaced brackets 50*a* having slots 50*b* which receive the edge. There is a screw clamp 50*c* which tightens against the lower surface of the edge to clamp the guide plate in a desired position along the conveyor. This sets the position of mechanism A in operational relation to the boxes 16**.

Referring now in more detail to the carriage 48, it will be seen that the carriage includes a plate 70 and a plate 72 which are joined together by means of a plastic or nylon block 74 and lower block 76 having grooves **74*a*, 76*a* formed therein for slidably receiving the guide plate 50. Bolts fasten plates 70, 72** together.

The plate 70 includes a journal hub **70*a* which rotatably receives the rocker shaft 46. The end of the rocker shaft 46 has affixed thereto a bell crank cam follower means which includes a crank arm 80 and a crank pin 82. The crank pin 82 is received in the guide slot 52 and follows the slot to impart a prescribed flap opening motion to the flap opening foot 54 by way of the rocker shaft 46**.

The flap opening foot 54 is carried adjustably at the end of the rocker shaft 46 by means of a block 84 having bolts 86 extending therethrough which extend through slots 88 in the flap engaging foot 54. The flap engaging foot 54 may then be slid relative to the block 84 so that the foot may be adjustably positioned.

The foot need be adjustably positioned on the end of the rocker shaft so that it may be adjusted to fit into a partitioned socket 89 in the box 16 during its prescribed flap opening motion. Adjustment of mechanism A along the length of flap engaging means 68 also aids in adjusting rocking of foot 54 in and out of a socket.

Figure 2:
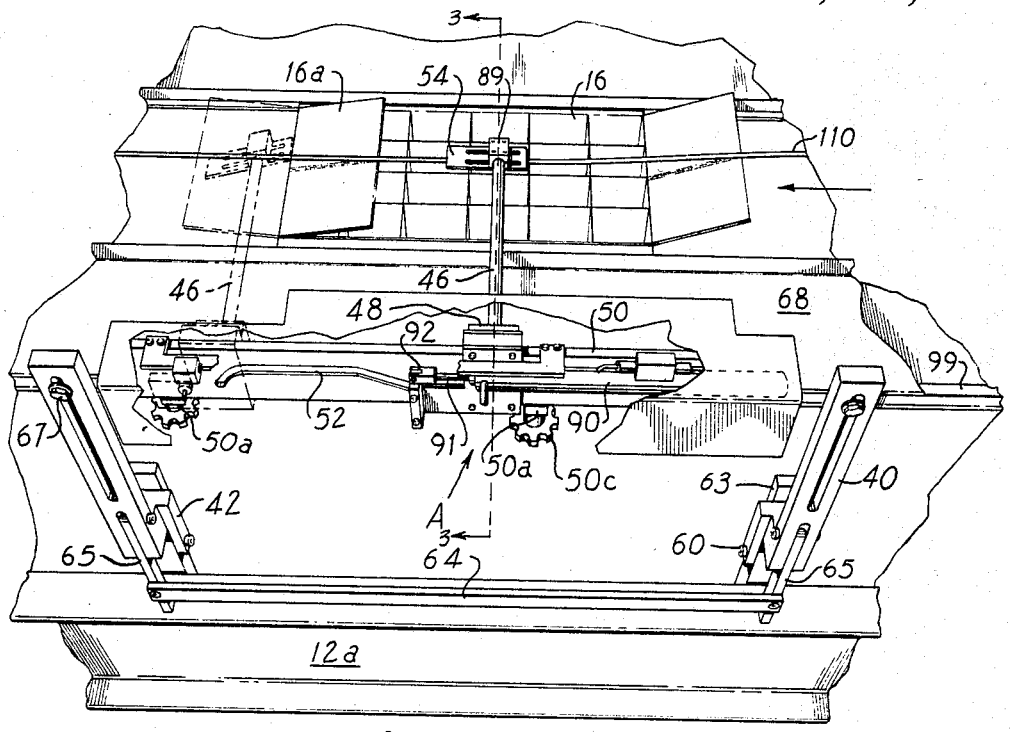
FIG. 2 is a perspective view illustrating apparatus for opening the main end flaps on an article packing machine constructed according to the present invention.

There is a double-action air cylinder 90 connected to a block affixed to plate 50. The cylinder has a piston 91 connected by a fork connector 92 to carriage 48, as can best be seen in FIG. 2.

The flap engaging foot means 54 engages a front flap 16*a* of the box 16 while the side flaps 16*b* and 16*c* are held by a constraint means provided by flap engaging means 68, 69. Flap engaging means 68 includes a pair of vertically spaced plates 94 and 96 carried on one side of the box and flap engaging means 69 includes a pair of spaced plates 98 and 100 carried on the opposing side of the box. A sandwich space is created between each pair of vertically spaced plates wherein the side flaps are sandwiched therebetween to constrain movement of the box during the lifting action of the flap opening foot and for holding the side flaps in an opened position. The plates are spaced by a spacer bar 99. The plates are sufficiently wide to accommodate a variety of side flap widths and hold them positively without disengagement.

In opening flaps on boxes with partitioned sockets, as carriage 48 begins to move forward foot 54 rotates downwardly into the box and below the flap 16*a*. As a result, there is very little forward movement until the foot 54 is under the closed flap. This permits dropping of the foot into a socket space of a box defined by partitions 89 since there is very little forward movement. When the cam follower 82 hits the bottom cam slot portion 52*b*, the foot starts coming upward with very little forward motion. Therefore, the foot can dip into and out of the partition space 89 for engaging and lifting the flap within this socket space.

There are a pair of divergent guide flaps 94*a*, 96*a* and 98*a*, 100*a* carried on the ends of plates 94, 96 and 98, 100 which guide the flaps into the flap engaging means 68, 69. A plow device 101 spreads the major flaps 16*b* and 16*c* apart for entry into the guide flaps and finally into flap engagement means 68, 69.

There is a rear flap opening means illustrated in the form of a pivotable arm 102 having a flap engaging claw 104 carried at the end thereof. The pivoting arm means 102 is carried on a shaft 106 above the boxes 16 on the conveyor by a rigid arm 107 about which arm 102 pivots. When a rear flap 16*d* is closed, the pivoting arm is first engaged by the forward end of the box 16 and rotated upwards. After passing the forward end of the box, and the front flap 16*a*, the arm pivots back downwardly to a rear flap engaging position under the force of a biasing spring 108. When a closed rear flap 16*d* approaches the flap engaging claw 104, the lip of the claw engages the edge of the rear flap 16*d*. As the box 16 continues to be conveyed, the flap is lifted under the force of the box being conveyed while being caught by the claw and moves toward an open position. A resilient cord 110 engages the flap and continues to force flap 16*d* down to the open position where it is held by the cord.

Once the front and rear flaps are moved to an open position, the flaps are retained in this position by the elongated elastic retaining means 110 which is illustrated in the form of the elastic cord carried above the conveyor and above the boxes. The retaining cord also constrains the motion of the box during the flap opening operations. The cord is attached at one end to plow device 101 by a nut and bolt 112 and to the opposing end of the conveyor frame at the forward end 10*a*.

While the apparatus for opening the box flaps of a box container thus described may be utilized with any suitable type conveyor the rake conveyor 26 illustrated herein is particularly useful. Elongated reciprocating rake 26 is carried alongside the conveyor 22, 24 and includes an elongated linkage assembly 120 which reciprocates and carries the pivoting dogs 28. The linkage assembly includes a first linkage bar 122 which is slidably carried by the frame of the conveyor and a second linkage bar 124 which is generally parallel with the first linkage bar. Bars 122, 124 reciprocate but move relative to one another at the onset of reciprocation to cause dogs 28 to pivot outwardly before moving forwardly.

Slide blocks 126 are affixed to a top frame plate 128 and include a C-shaped channel 126*a*, as can best be seen in FIG. 11, which slidably receives the linkage bar 122. The entire reciprocating conveyor rake is slidably suspended from the plate 128 alongside the stationary conveyor platform 24.

The linkage bar 124 includes a pivot pin 124*a* about which the dog 28 pivots. There is an arcuate slot formed in each dog in which a guide pin (not shown) carried by the linkage bar 122 is received. A pivot pin 122*a* is carried by the bar 122 which is pivotably connected to each dog 28. By this means, the individual dogs 28 are pivotably carried and guided by the linkage bar assembly 122, 124.

An air cylinder 130 has a reciprocating piston rod 132 guided by means of a guide bar 134 which has one end affixed to the frame 10 through member 128. Air cylinder 130 is affixed to the underneath side of frame plate 128.

Affixed to the end of the piston rod 132 is an engagement connector member 136 having a sleeve which slides over the guide bar 134. The engagement connector 136 engages and connects the piston rod with the reciprocating linkage bar assembly 122, 124. The connector fits in a one-to-one fit with the linkage bar 124 and in a wider slot formed in linkage bar 122. In this manner, upon the forward stroke of the piston, the connector 136 moves the linkage bar 124 one-to-one while moving the linkage bar 122 only after a free space in the slot has been overcome. This action causes bar 124 to move before bar 122 on the onset of reciprocation to swing the dogs 28 outwardly to a container engaging position prior to the rake being advanced forwardly on the advance stroke of the rake.

As can best be seen in FIGS. 9 and 10, there are four dogs 28 on the rake conveyor A. Thus, the rake conveyor handles and advances four containers 16 at a time on the conveyor path. The boxes are released onto the path by an indexing device 140 which releases a box when actuated by the machine control circuit. Upon actuation of the rake conveyor by means of the air cylinder 130 the four containers will be advanced incrementally along the conveyor as can best be seen in FIG. 10.

At the end of the advancement stroke of the rake conveyor, positioning blocks are provided to stop and position the containers at selected positions along the length of the conveyor at which flap opening and bottle loading operations may occur.

There are positioning blocks 142, 144, 146 and 150. There is an additional block 148 which is used as sensing and switching members. For example, block 148 senses the presence of a box in the packaging position to effect dropping and loading of the articles into the container.

The block 146 stops a box on the moving conveyor 22 and holds the container in a rake pickup position for pickup by the rake conveyor on its forward stroke. Block 150 stops the box in a next rake pickup position. Block 144 stops and positions a container in a next position for the flap opening operation. Positioning block 142 stops the box positively in the packaging position so that it will be in alignment for the loading of bottles or other like articles. A switch is actuated by the sensing block 148 as part of a conventional control circuit (not shown) for loading the articles in the containers.

So that different size boxes may be accommodated on the conveyor and article loading machine, the positioning blocks are made adjustable by means securing them in slots 152 formed in a top frame member 154 which is affixed to the frame 10. The blocks are spring biased to a blocking position which will ordinarily not be overcome by the box inertia upon reaching the end of the rake advancement stroke. However, on the next advancement stroke the box will be picked up by the next successive dog and be conveyed past the block at the beginning of the advancement stroke.

Switch means for sensing the position of the rake is provided by a return sensing switch 160 to sense the rake in its return position at the switch and a forward position switch 163 which senses the advancement of the rake. Both switches are actuated by an abutment 166 carried on the linkage bar 124.

Upon advancement, a box will enter the flap opening station at block 144. Flaps 16*a* will be pushed closed by plow 101 if not fully opened and flaps 16*b* and 16*c* will be separated by plow 101 and guided and sandwiched between flap engaging plates 68 and 69 wherein they are held and the box constrained. Prior to reaching block 144 rear flap 16*d*, if not already open, will be caught by pivoting claw 104 whereupon further advancement to block 144 will cause flap 16*d* to fold outwardly to the open position and be retained therein by cord 110. Once stopped at block 144, flap mechanism A will be set into motion by suitable conventional controls (not shown) which admit air to inlet 90*a* of air cylinder 90 moving carriage 48 from right to left as can best be seen in FIGS. 2, 5, and 6.

Tracing movement of the flap engaging foot, cam pin 82 starts in slot 52 at 52*a* wherein the foot is horizontal. Upon reaching slot portion 52*b*, foot 54 is rocked downwardly. Afterwards and along slot portion 52*c* the foot is rocked upwardly whereupon it engages underneath flap 16*a*. Forward movement of the cam pin in slot portion 52*d* moves upward turned foot in translational motion to push flap 16*a*. In movement in slot portion 52*e*, foot 54 again rocks downward where flap 16*a* is pushed fully open and downwardly and engaged by cord 110 and held fully open. One flap 16*a* is lifted upright by the foot, elastic cord 110 will aid in pushing flap 16*a* fully open if necessary. Upon reaching the end position carriage 48 hits a reversing switch whereupon air is sent to the other inlet 90*b* of the air cylinder sending the carriage and opening foot back to the start position.

In the article loading position, as is container 16 illustrated in FIG. 9, bottles will be loaded through an elevator grid set 34. Bottles are separated in lanes 38 and conveyed to the grid set 34 in a conventional manner.

The opposing inside edges of top frame plates 128 and 154 define a guide channel through which the boxes slide and are conveyed.

Figure 13:
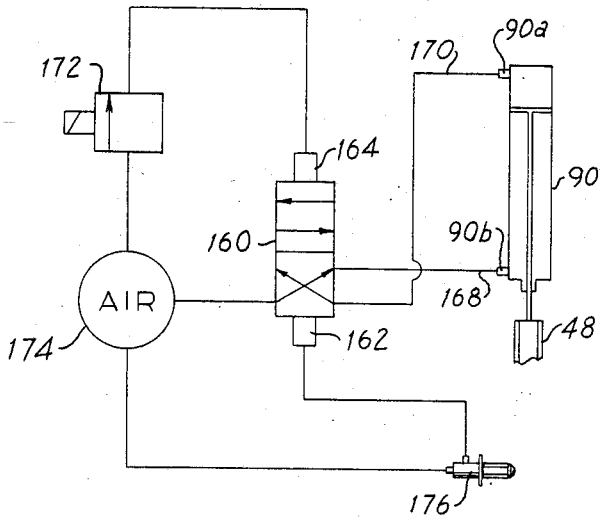
FIGS. 12 and 13 are schematic diagrams of a circuit for operating flap opening apparatus according to the invention.
Figure 12:
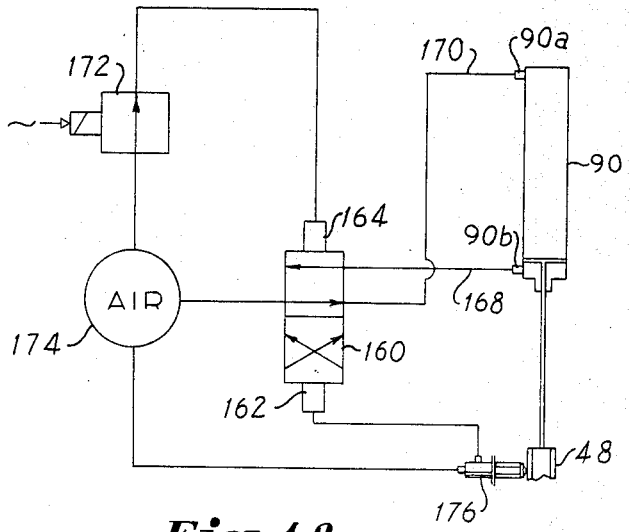

While any suitable control may be had for moving carriage 48 in reciprocating motion, FIGS. 12 and 13 are a schematic illustration of a suitable pneumatic circuit for controlling air cylinder 90 using conventional hardware. There is a five-way, two position pilot-operated valve illustrated schematically as valve piston 160 which may be any suitable valve such as that manufactured by the Clippard Instrument Lab of Cincinnati, Ohio. Such a valve has control ports 162 and 164 to which air is admitted for moving the schematic valve piston 160 left and right. The valve piston 160 is connected via lines 168 and 170 to air inlets 90*b* and 90*a* of air cylinder 90.

Upon receipt of a signal from the control circuit (see FIG. 12), a solenoid operated valve 172 is opened admitting air to control port 164 moving the valve body to the position shown in FIG. 12. Air from supply 174 flows through the valve into line 170 and is vented through line 168 so the piston rod moves out. As soon as the carriage 48 abuts a return valve 176, the valve is opened and air is delivered to control port 162 whereupon the valve piston moves (see FIG. 13) connecting inlet 90*b* to air supply 174 while air is exhausted through line 170 causing the piston rod to move to the position shown in FIG. 13. This completes one cycle of the flap opening motion of the carriage 48 and flap opening foot 54.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. In an article packing machine of the type having a container conveyor on which boxes are conveyed to be loaded with articles, an article conveyor for conveying articles to an article loading station, a grid set at the article loading station which receives the articles and arranges the articles for loading and packing of the articles in said boxes, said boxes being of the type having front and rear end flaps and side flaps for closing the top of the box, apparatus for opening the flaps of the boxes to insure the box top is open for loading comprising:

a flap opening mechanism adapted for being carried on a frame of said machine;

a movable flap opening engagement means carried by said mechanism for movement in a prescribed motion to engage a closed end flap and move said end flap toward an open position;

programmed control means carried by said assembly and connected to said flap opening means for moving said flap opening means in said prescribed motion; and elongated elastic cord means carried above said box along said conveyor and which yields to the lifting of said closed end flap while forcing and retaining said flap open.

2. The apparatus of claim 1 wherein said flap opening means includes:

a rocker shaft rotatably carried by said assembly connected to said programmed control means;

flap engaging foot means carried adjacent an end of said shaft; and said programmed control means furning said shaft to impart a down and up motion to said flap engaging foot means to move said foot means under said closed flap to raise said closed flap toward said open position.

3. The apparatus of claim 2 including pivotable claw means carried by said frame above said box conveyed on said conveyor platform and having a lip catching a closed rear end flap of said box under conveyance, and said closed rear flap being lifted to an open position under the force of conveyance.

4. The apparatus of claim 1, further including constraint means for holding said side flaps while said flap opening means lifts and opens said closed flap.

5. Apparatus for opening the closure flaps of an empty box conveyed on a conveyor of an article loading machine prior to being filled with articles on said machine comprising:

a front flap opening foot means for engaging a front end flap of said box and moving said flap toward an open position;

means for moving said flap opening foot means in a prescribed flap opening motion in which said foot means dips beneath said closed front end flap and moves said flap toward said open position;

a rear flap opening claw means pivotably carried above said box on said conveyor for engaging a closed rear end flap;

means conveying said box past said claw means causing said rear flap to be lifted from a closed position toward an open position; and retaining means carried by said machine and engaging said front and rear flaps of said boxes being lifted open to aid in opening said flaps and maintaining said flaps open during conveyance.

6. The apparatus of claim 5 including:

means for stopping said box while said front flap opening foot means moves in said prescribed motion and conveying said box while said rear flap is engaged by said rear flap opening claw means.

7. In an article packing machine of the type having a container conveyor on which boxes are conveyed to be loaded with articles, an artilce conveyor for conveying articles to an article loading station which receives the articles and arranges the articles for loading and packing of the articles in said boxes, said boxes being of the type having front and rear end flaps and side flaps for closing the top of the box, apparatus for opening the flaps of the boxes to insure the box top is open for loading comprising:

a flap opening mechanism adapted for being carried on a frame of said machine;

a movable flap opening engagement means carried by said mechanism for movement in a prescribed motion to engage a closed end flap and move said end flap toward an open position;

programmed control means carried by said assembly and connected to said flap opening means for moving said flap opening means in said prescribed motion; and spaced parallel flap engaging plates carried adjacent said conveyor at said flap opening mechanism, said spaced places defining a sandwich space in which side flaps of said boxes are held to constrain said boxes while said flap opening means lifts and opens said closed flap.

8. The apparatus of claim 7 including guide flap means carried by said flap engaging plates for guiding said side flaps into said sandwich space.

9. Apparatus for opening the flaps of a box being loaded on an article loading machine, said loading machine being of the type having a conveyor carried on a machine and conveyor frame along which said boxes are conveyed for delivery to an article loading station, a grid set carried by said conveyor frame to which articles are conveyed to loading in said box through said grid set, said apparatus comprising:

a flap opening station located along said conveyor;

said flap opening station including a flap opening mechanism carried adjacent said conveyor on said frame;

rocker shaft means includes in said flap opening mechanism;

carrier means carried by said flap opening mechanism, said rocker shaft means being carried by said carrier means;

a flap engaging foot means carried by said rocker shaft means for engaging a closed end flap of said box and lifting said flap toward an open position;

said carrier means including connecting means connected to said rocker shaft means for moving said flap engaging foot means in an up-and-down motion causing said foot means to engage said closed end flap and lifting said flap toward said open position; and constraint means for constraining the movement of said box when said end flap is engaged by said flap engaging foot means to constrain said box against the lifting motion of said foot means.

10. The apparatus of claim 9 including constraint means for constraining the movement of said box when said end flap is engaged by said flap engaging foot means to constrain said box against the lifting motion of said foot means.

11. The apparatus of claim 9 wherein said conveyor includes positioning means for stopping the forward conveyance of said box at said flap opening station so that said flap engaging foot means may be moved relative to said box to engage said closed end flap.

12. The apparatus of claim 9 wherein said flap opening mechanism includes:

an elongated guide plate carried by said frame;

said carrier means includes a carriage slidably carried by said guide plate;

said rocker shaft means being rotatably carried by said carriage means; and said connector means being connected between said guide plate and rocker shaft means.

13. The apparatus of claim 12 including cam means connecting said rocker shaft means to said elongated guide plates to impart said rocking motion to said rocker shaft means as said carriage moves in translational motion along said guide plate.

14. The apparatus of claim 13 wherein said cam means includes:

a cam guide slot carried by said elongated guide plate;

cam follower means carried by said rocker shaft means including a follower received in said cam slot for rocking said rocker shaft means to impart a proscribed flap engaging motion to said flap engaging foot means.

15. The apparatus of claim 14 wherein said cam means imparts a downward rocking motion to said flap engaging foot means followed by an upward rocking motion of said flap engaging foot means to rotate said flap engaging foot means under said closed end flap and then lift said closed end flap over the front side of said box toward an open flap position.

16. The apparatus of claim 14 wherein said cam follower includes a bell-crank linkage affixed to rocker shaft means having a crank follower received in said cam slot.

17. The apparatus of claim 15 wherein said cam means imparts a second downward rocking motion to said flap engaging foot means to push said flap positively downward toward said open position.

18. The apparatus of claim 15 including retaining means carried by said machine frame for engaging said flap lifted toward said open position by said foot means and pushing said flap fully open while engaging said flap to retain it open during further conveyance.

19. The apparatus of claim 13 wherein said flap engaging foot means is adjustably carried adjacent an end of said rocker shaft means so that said foot means may rock down and then up within a partitioned socket space formed in said box.

20. The apparatus of claim 9 wherein said carrier means is carried by said mechanism for translational motion while said rocker shaft means is carried by said carrier means for rotational motion.

21. The apparatus of claim 9 including actuator means for moving said carrier means in a longitudinal motion.

22. The apparatus of claim 9 wherein said box is the type having a plurality of individual socket spaces defined by partitions for containing individual ones of said articles, said connecting means including cam means for rocking said foot means into and out of said socket space with little forward movement to engage and lift said closed flap within the space of said partitioned socket.

23. Apparatus for opening the flaps of a box being loaded on an article loading machine having a conveyor frame, a conveyor carried by said conveyor frame for conveying said boxes to the articles to be loaded, said apparatus comprising:

a movable flap opening means carried by said conveyor frame for movement in a prescribed path to engage a closed flap on the box and move it toward an open position;

carrier means carried by the conveyor frame for carrying said flap opening means adjacent the conveyor;

programmed control means for moving said flap opening means in said prescribed path to engage and open said close flap; and constraint means carried by said conveyor frame for engaging said box and effectively constraining movement of the box during opening of the flap.

24. The apparatus of claim 23 wherein said programmed control means includes a cam means carried by the conveyor frame and a cam follower carried by the flap opening means in engagement with said cam means, the cam means is contoured to impart the prescribed motion to the flap opening means through the cam follower means.

25. The apparatus of claim 23 including:

an elongated guide plate;

a slidable carriage slidably carried by said guide plate;

a cam slot formed in said guide plate having a predetermined pattern for producing said prescribed motion; and a cam follower engaged in the cam slot for moving said flap opening means in said prescribed motion.

26. The apparatus of claim 24 wherein said box is the type including a plurality of partition socket spaces in said box for containing an individual one of said articles, said programmed control means including said cam means moves said flap opening means downwardly and upwardly without substantial forward movement to reach into one of said socket spaces for engaging underneath said closed flap said lift said flap toward an open position.

* * * * *